US005254167A

United States Patent [19]

Janoski et al.

[11] Patent Number: 5,254,167

[45] Date of Patent: Oct. 19, 1993

[54] ADHESIVE APPLICATION APPARATUS

[75] Inventors: Ronald J. Janoski, Chagrin Falls; Richard J. Gibson, North Olmsted; Donald C. Portfolio, Solon; Gregory J. Rudolph, Novelty; Todd P. Hadaway, North Ridgeville, all of Ohio

[73] Assignee: Tremco, Inc., Beachwood, Ohio

[21] Appl. No.: 757,161

[22] Filed: Sep. 10, 1991

[51] Int. Cl.[5] ..... B05C 11/02; B05C 5/00; B05B 13/02

[52] U.S. Cl. ..... 118/108; 118/305; 118/315; 401/48

[58] Field of Search ..... 401/48; 118/108, 305, 118/315, 323

[56] References Cited

U.S. PATENT DOCUMENTS

| | | | |
|---|---|---|---|
| 57,091 | 8/1866 | Coe | 118/108 |
| 1,393,747 | 10/1921 | Cannon | 118/108 |
| 2,273,599 | 2/1942 | Smith et al. | 401/48 |
| 2,847,689 | 3/1956 | Miller | 401/48 |
| 3,099,582 | 7/1963 | Ongstad et al. | 401/48 |
| 3,135,430 | 6/1964 | Caldwell | 401/48 |
| 3,148,104 | 9/1964 | Rapp | 118/108 |
| 3,208,094 | 9/1965 | Pilkington | 401/48 |
| 3,305,887 | 2/1967 | Turner | 118/108 |
| 3,804,696 | 4/1974 | Lobmeier | 118/108 |
| 4,055,384 | 10/1977 | Palzer | 401/48 |
| 4,165,192 | 8/1979 | Mellen | 401/48 |
| 4,537,331 | 8/1985 | Matula | 401/48 |
| 4,629,094 | 12/1986 | Vogel et al. | 401/48 |
| 4,653,424 | 3/1987 | Schloss et al. | 118/108 |

*Primary Examiner*—W. Gary Jones
*Assistant Examiner*—Steven P. Griffin
*Attorney, Agent, or Firm*—Konrad H. Kaeding; Gunther J. Evanina; David P. Dureska

[57] ABSTRACT

An apparatus (10) for applying fluid roof panel adhesive to a substrate includes a holding tank (12) for holding a supply of adhesive vertically above the substrate. The tank is supported by a pair of spaced wheels (14) and has a handle (16) to enable moving the device over the substrate. Openings (32) in a lower wall (30) of the tank enable adhesive to flow onto the substrate. Blocking members (36) associated with each opening are movable in response to the position of a lever (20) to enable or prevent flow of adhesive through the openings. Movement of the apparatus over the substrate provides for controlled deposition of uniformly spaced beads of adhesive suitable for holding roof panels to the substrate.

23 Claims, 9 Drawing Sheets

ADHESIVE APPLICATION APPARATUS

TECHNICAL FIELD

This invention relates to roofing systems having roof panels adhered to a substrate material. Specifically, this invention relates to an apparatus and method for applying adhesive to a substrate in controlled amounts suitable for holding covering panels on a roof substrate.

BACKGROUND ART

A common roof construction used for commercial buildings includes a substrate covered by one or more layers of insulating or covering panels. In such systems, the substrate may commonly be fluted steel roof deck panels, a concrete slab or other materials.

In the past, panels have usually be held to the substrate using fasteners on hot asphalt. The use of fasteners adds significant expense to the roof construction, both in material and labor costs. Fasteners also present potential areas for failures because they may been subject to corrosion or damage.

The proper installation of an adhesive bonded roof panel system requires proper adhesive coverage over the substrate. Too little adhesive in certain areas may result in an inadequate bond. Too much adhesive is wasteful and costly. When the substrate material is fluted, adhesive need only be applied to the raised flanges of the substrate as any adhesive that falls into the flutes between the flanges generally will not contribute to holding the overlying panels.

The only adequate prior art method known to applicants for applying roof panel adhesive to a substrate is to pour the adhesive onto the substrate from a bucket or container. This method does not provide consistent application of the adhesive. In some cases, too much adhesive is applied and the excess is wasted. While in others, too little material is applied to the substrate. The problem of using this prior art method is particularly severe when the substrate is fluted. It is not uncommon for workers to miss the flanges when pouring the adhesive, which results in adhesive falling into the flutes, where it is wasted. This prior art method is also very time consuming and physically exhausting. It can also be very messy as pouring the adhesive may cause it to splash onto workers and equipment.

Thus there exists a need for an apparatus and method for accurately applying adhesive material to a substrate for holding roof panels thereto.

DISCLOSURE OF INVENTION

It is an object of the present invention to provide an apparatus and method for applying roof adhesive to a substrate in selected locations and in measured amounts.

It is a further object of the present invention to provide an apparatus and method for applying roof adhesive to a substrate that enables applying the adhesive more quickly, more consistently and with less effort.

It is a further object of the present invention to provide an apparatus and method for applying roof adhesive that minimizes waste when the adhesive is applied to a fluted substrate.

It is a further object of the present invention to provide an apparatus and method for applying roof adhesive to various fluted substrates having differing flange spacing.

It is a further object of the present invention to provide an apparatus and method for applying roof adhesive to a substrate at varying densities.

It is a further object of the present invention to provide an apparatus and method for applying roof adhesive that provides for spreading the adhesive on the substrate after it is deposited thereon.

Further objects of the present invention will be made apparent in the following Best Modes for Carrying Out Invention and the appended claims.

The foregoing objects are accomplished in the preferred embodiment of the invention by an apparatus and method for applying fluid roof adhesive in selected locations and in measured amounts onto a substrate to which roof panels may be bonded. The apparatus includes a holding tank located vertically above the substrate. The holding tank holds a supply of the adhesive material. The holding tank is supported above the substrate by a pair of spaced wheels.

The wheels are sized and spaced to fit between the flanges on standard fluted roof panel surfaces. Preferably, the wheels are of a sufficient width that they partially fall into and are guided by the flutes, but are not so narrow as to fully engage the flutes. Such partial engagement of the applicator wheels allows for easy alignment and easy disengagement of wheels from the flutes once a row is completed and a new row is to be covered with adhesive. To achieve such partial engagement between the wheels and the flutes, the wheels optionally can define a convex contacting surface (the middle portion of the wheels defining a greater diameter than the edge portions) and a width which is wider than the flutes; in this way, the middle portion of the wheel will engage into the flutes, but the outer edges are free of the flutes to thereby allow the operator to easily disengage the applicator from the flutes.

The holding tank has a plurality of spaced openings in its lower wall. The openings are spaced so that they are positioned above the flanges on the fluted substrate.

Valve means is provided for selectively enabling adhesive to pass through the openings in the lower wall of the tank. The valve means include a rotatable shaft that is connected through a link to a manually movable lever. A plurality of blocking plates, each sized for blocking an associated opening, are attached to the shaft through lockable collars. In a first position of the shaft, the blocking plates abut the openings preventing flow therethrough. In a second position of a shaft, the plates move 90° away from the blocking position. This enables adhesive to flow through the openings onto the flanges of the substrate.

The apparatus further includes a handle to enable pulling the device over the substrate. This enables the device to deposit uniform ribbons or beads of adhesive on the tops of the flanges. The speed at which the apparatus is moved determines the amount of adhesive applied to the top of each flange. When the end of a substrate panel is reached and adhesive is no longer to be deposited, the lever is moved to rotate the shaft and blocking plates to close the openings. The apparatus can then be moved and positioned to apply adhesive to adjoining flanges of the substrate.

In some applications it is not necessary to apply adhesive to each flange of a substrate. In such cases, the blocking plates associated with certain openings can be disconnected from the rotatable shaft by unlocking the collars which normally hold the blocking members thereto. A locking mechanism which includes fingers to hold the blocking plates closed are provided on the underside of the tank wall. By holding certain blocking plates in the closed position, the apparatus may be used to apply adhesive only to selected flanges of the substrate.

The apparatus may also be used to apply adhesive to flat or other contoured surfaces. In such cases, the apparatus may be used to provide uniform beads for holding roof panels to the flat substrate. Selectively closing openings in the bottom of the tank with the locking mechanism also enables control of the amount of adhesive applied.

Alternative embodiments of the invention provide for adjustable spacing between the wheels on the device and additional openings for depositing adhesive material from the holding tank. This enables adjustment of the apparatus so it may be used to apply adhesive to the flanges of fluted substrates having varying configurations and differently spaced flanges. Alternative embodiments of this invention may also incorporate a squeegee for automatically spreading the adhesive on the substrate after it is deposited.

BEST MODES FOR CARRYING OUT INVENTION

Figure 1:
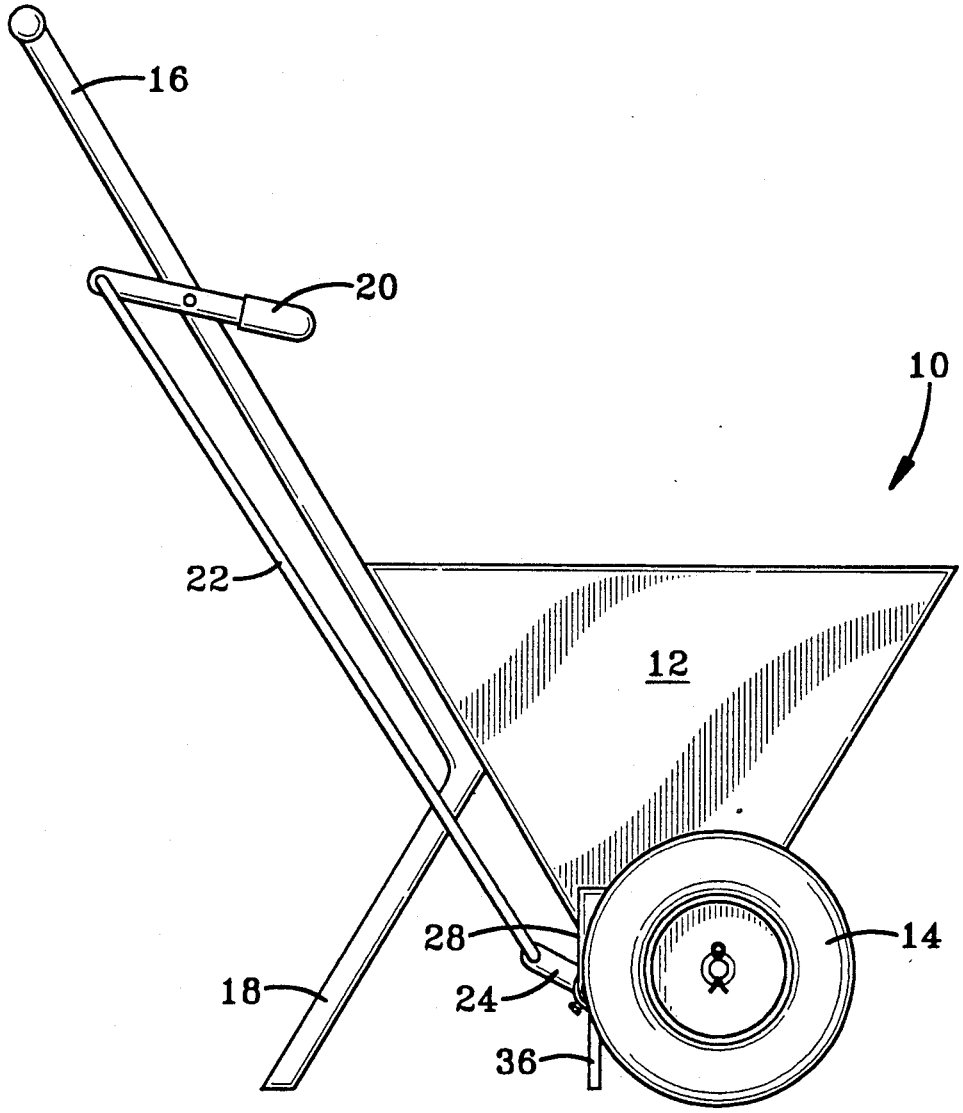
FIG. 1 is a side view of a first embodiment of the adhesive application apparatus of the present invention.

Referring now to the drawings and particularly to FIG. 1, there is shown therein a first embodiment of the adhesive application apparatus of the present invention generally indicated 10. The apparatus includes a holding tank 12 which serves as holding means for holding a supply of fluid roof adhesive. The apparatus is supported by a pair of wheels 14. The device also has a handle 16 which is used for manually moving the device. A prop leg 18 may be used to hold the device upright when the handle is not being held.

A lever 20 is pivotally mounted to handle 16. Lever 20 is connected to a link 22 which is movable with lever 20. Link 22 is connected to an ear 24 which extends outward from a rotatable shaft 26 (see FIG. 5). Shaft 26 is journaled in openings which extend through a pair of supports 28 which are welded to and extend downward from tank 12.

Figure 2:
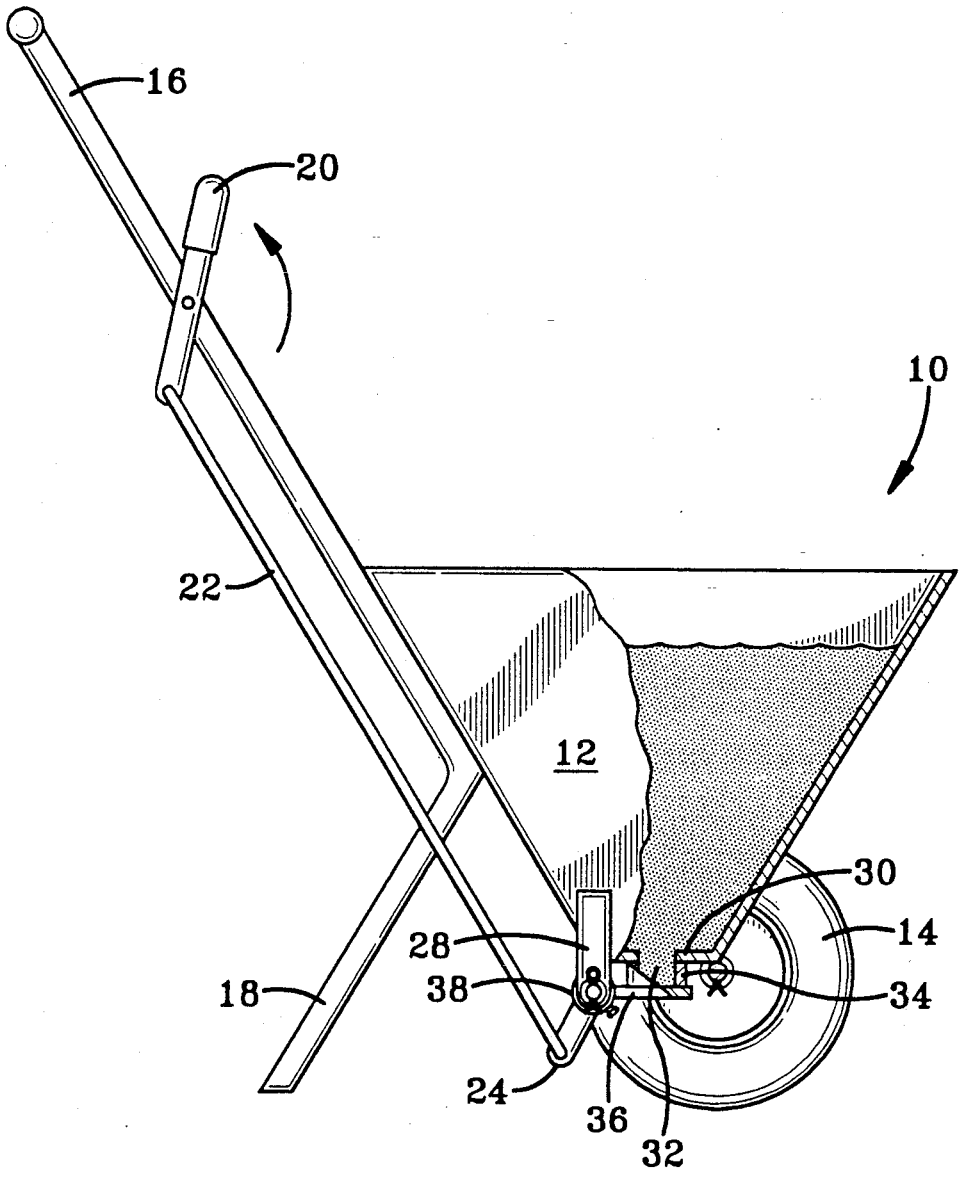
FIG. 2 is a partially sectioned side view of the adhesive application apparatus shown in FIG. 1.
Figure 5:
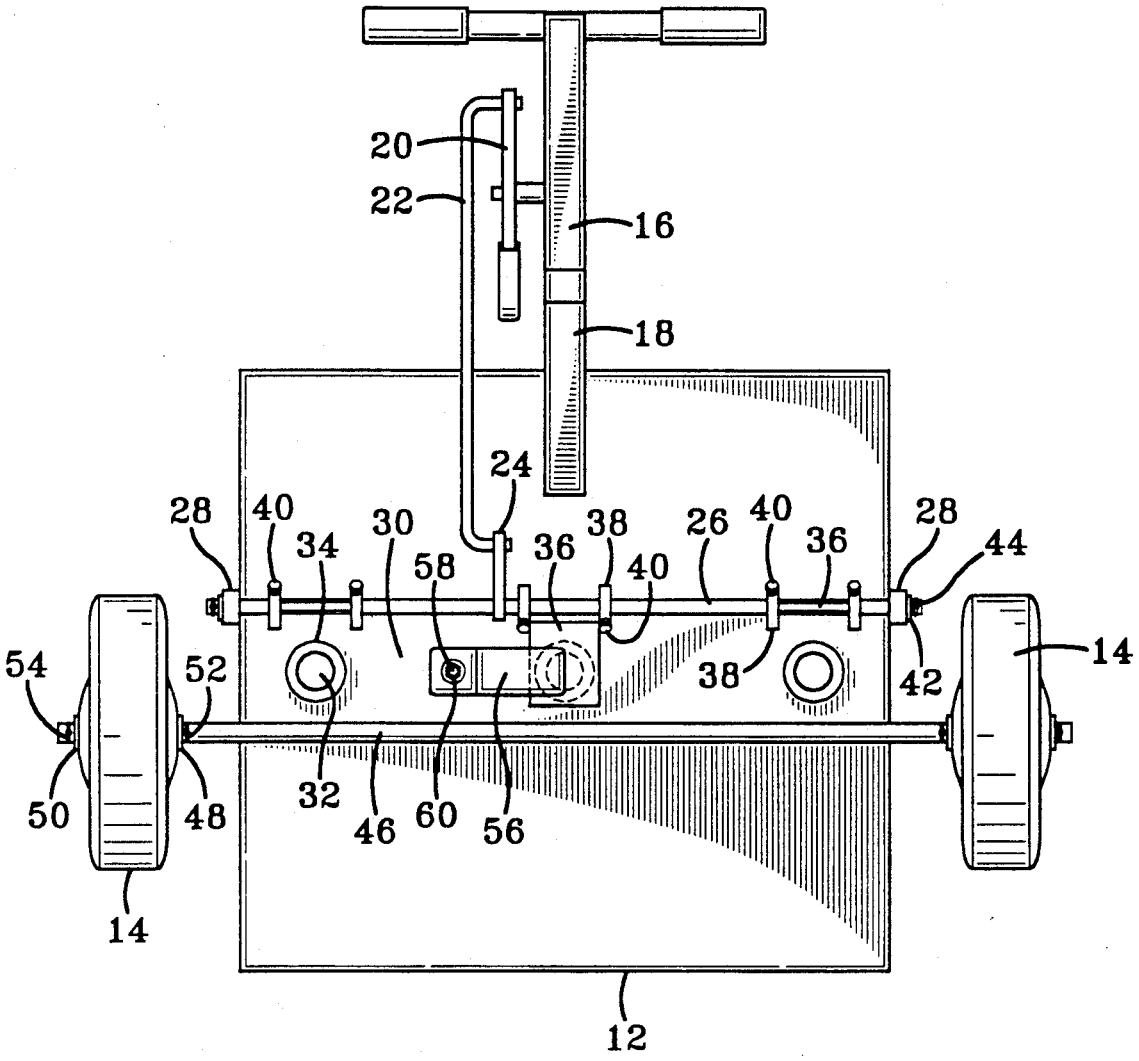
FIG. 5 is a bottom view of the adhesive application apparatus.

As shown in FIGS. 2 and 5, tank 12 has a lower wall 30. A plurality of openings 32, extend through the lower wall 30 of the tank. Openings 32 are bounded by short cylindrical extensions 34 that extend slightly below the outside bottom wall of the tank. Openings 32 have a flat lower face. These openings are sized to control the maximum flow rate of fluid adhesive therethrough, with the size depending on the viscosity of the adhesive used.

Shaft 26 has mounted thereon three (3) blocking members 36. The blocking members 36 are sized for blocking openings 32 when in an abutting relation therewith. The blocking members are each welded to a pair of lockable collars 38. Shaft 26 extends through the lockable collars. Each lockable collar 38 has a locking nut 40 which enables locking the collar (and the attached blocking member) to the shaft. Shaft 26 extends at its ends through supports 28 and is retained therein by washers 42 and pins 44 at each end.

As shown in FIG. 2, the blocking members 36 are oriented so that they are aligned. As a result, as shaft 26 rotates in response to movement of lever 20, the blocking members move from the first position shown in FIG. 2 to a second position as shown in FIG. 1. In the second position, the adhesive in the tank is enabled to flow through openings 32 onto the substrate material. Movement of lever 20 to the position shown in FIG. 2 moves the blocking members from the second position to the first position wherein the flow of adhesive through the openings is prevented by the abutment of the blocking members.

The wheels 14 and 14' which serve as support means for the apparatus are mounted on a shaft 46. The wheels are sized to fit between the flanges on standard fluted roof panel surfaces. Preferably, the wheels are of a sufficient width that they partially fall into and are guided by the flutes, but are not so narrow as to fully engage the flutes. Such partial engagement of the applicator wheels allows for easy alignment and easy disengagement of wheels from the flutes once a row is completed and a new row is to be covered with adhesive. To achieve such partial engagement between the wheels and the flutes, the wheels optionally can define a convex contacting surface (the middle portion of the wheels defining a greater diameter than the edge portions) and a width which is wider than the flutes; in this way, the middle portion of the wheel will engage into the flutes, but the outer edges are free of the flutes to thereby allow the operator to easily disengage the applicator from the flutes.

Shaft 46 is welded to the underside of tank 12. The wheels are held in position on each end of the shaft between an inner washer 48 and an outer washer 50. The washers are held in place between inner pins 52 and outer pins 54 which extend through holes in the shaft. These pins may be cotter pins as shown in the drawings or other types of holding pins.

Figure 6:
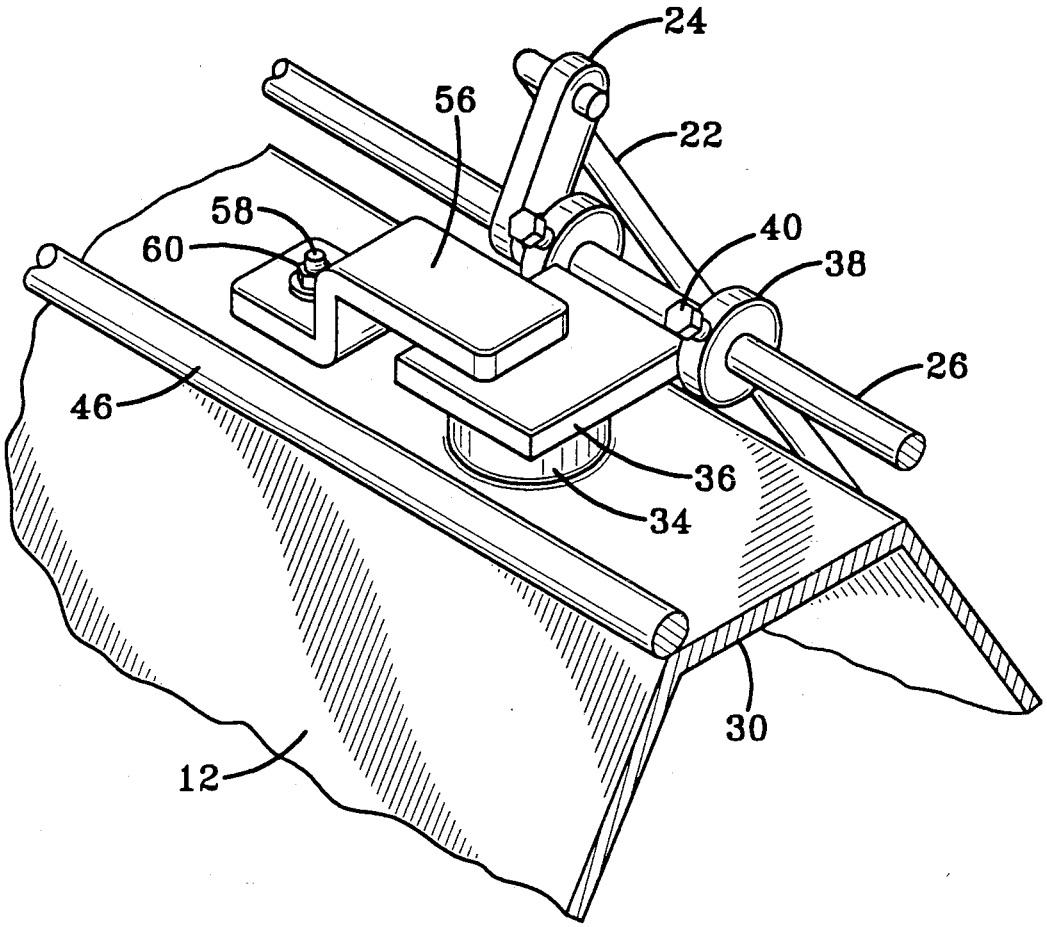
FIG. 6 is an enlarged fragmentary bottom perspective view of a locking finger and blocking member of the apparatus held in the closed position.

As best shown in FIGS. 5 and 6, engaging member means such as a finger 56 is pivotally mounted to a stud 58 which extends from the bottom of tank 12. Fastening means such as a nut 60 threaded on the stud 58 may be adjusted to fix or lock the finger in position. This assembly serves as locking means for holding the blocking member in a closed position. When finger 56 is in the position shown in FIGS. 5 and 6, it engages the blocking member and prevents its movement to the second position. By loosening the locking nuts 40 on collars 38 associated with the blocking member engaged by finger 56, the remaining blocking members can be moved between the first and second positions, while the engaged blocking member remains in the first position preventing flow through the associated opening.

Loosening nut 60 and rotating finger 56 about stud 58, enables the finger to disengage the associated blocking member. The locking nuts 40 associated with the blocking member may then be retightened which reengages the blocking member with shaft 26. This causes the blocking member to move between the first and second positions with the others and enables adhesive to again flow through the associated opening.

It is to be understood that although only one finger and stud assembly is shown in FIG. 5, other embodiments of the invention may have such a locking assembly for each blocking member. In this way, each member may be selectively disconnected from the shaft and held in the closed position. This provides for adjusting both the amount and location of the deposited adhesive.

Figure 3:
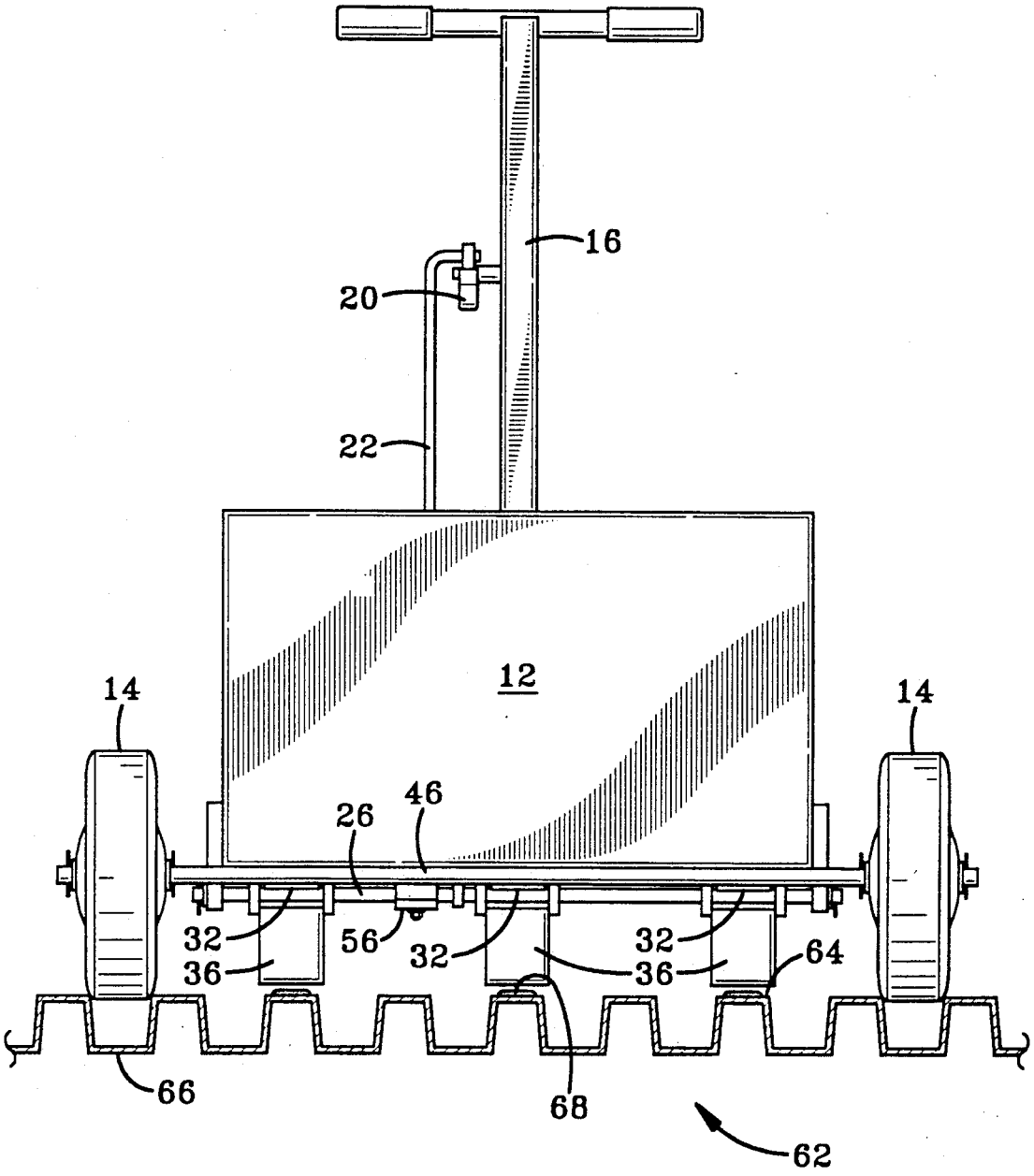
FIG. 3 is a front view of the adhesive application apparatus shown in FIG. 1.

The adhesive application apparatus of the present invention may be used to apply a controlled bead of adhesive on a fluted substrate. As shown in FIG. 3, a fluted substrate 62 has evenly spaced longitudinally extending flanges 64. Flutes 66 extend between the adjacent flanges. The flanges of adjacent panels typically correspond and extend the length of the roof surface. The wheels 14 of the device are spaced so that they nest within the flutes of the substrate 62.

The openings 32 from tank 12 are located so that they are above each flange 64. When the blocking members 36 are in the second position as shown in FIG. 3, adhesive flows from the tank 12 onto the flanges of the substrate.

Figure 4:
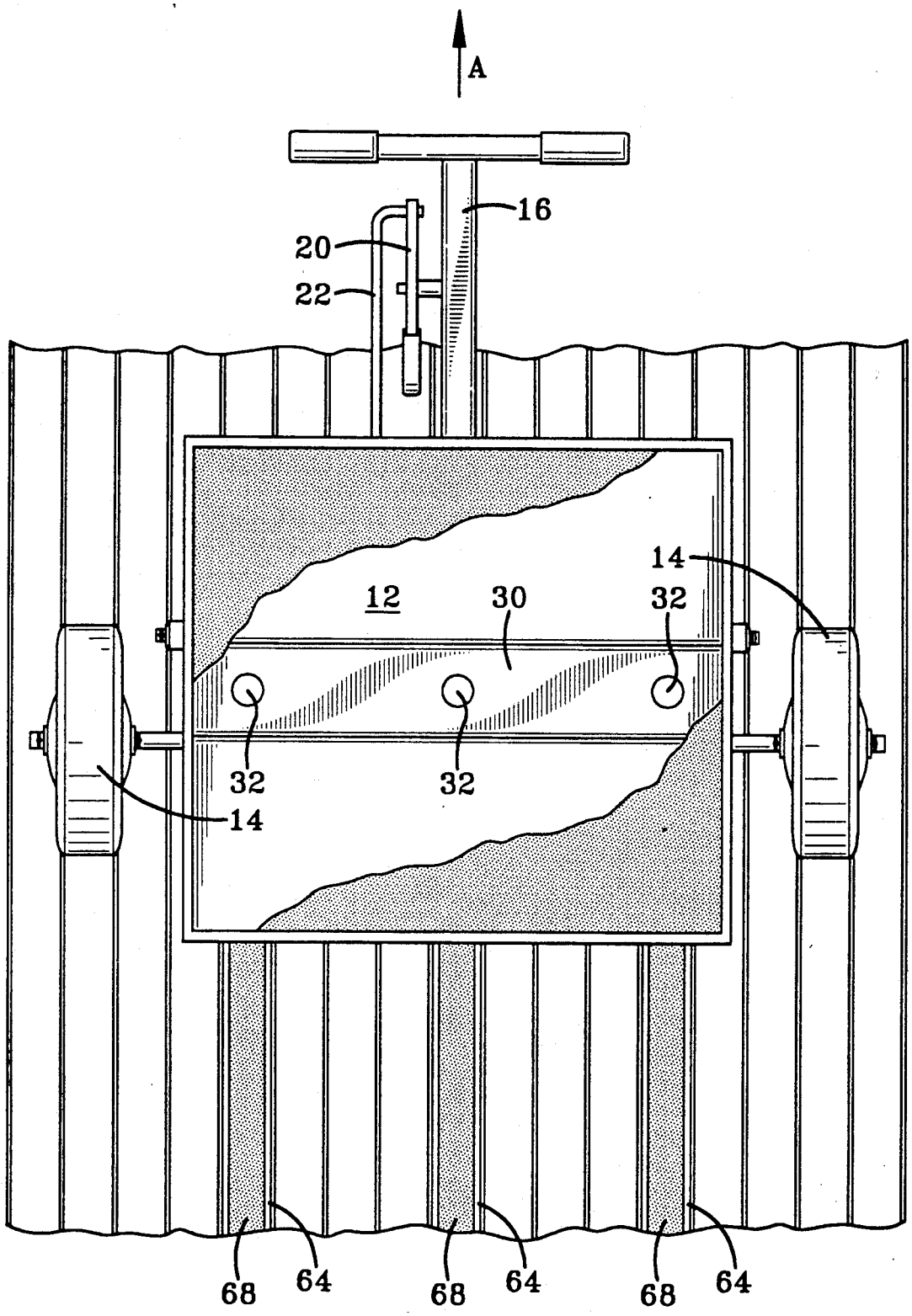
FIG. 4 is a top view of the adhesive application apparatus shown in FIG. 1.

In use, the device is moved manually by pulling handle 16 in the direction of arrow A as shown in FIG. 4. As the device is moved across the substrate, uniform beads 68 of adhesive are deposited on the flanges 64. The amount of adhesive deposited for any length of travel of the apparatus may be controlled by changing the speed at which the device is pulled over the substrate.

Adhesive is typically applied for the full length of the roof along the continuous flanges. When the flanges in one pass have been covered with a bead of adhesive, the lever 20 may be moved so that blocking members 36 close off the flow of adhesive through openings 32. The device is then moved to adjacent flanges and the flow of adhesive restarted so that beads may be deposited on the adjacent flanges. Of course the device may also be used to apply beads of adhesive on the surface of flat substrates.

The use of the device of the present invention provides uniform beads of adhesive in the proper locations for bonding covering panels to the substrate. The device reduces wasted adhesive and provides for accomplishing the work with less mess. This is aided in the preferred embodiment by the blocking means 36 which in the open condition extend downward between the openings 32 and the operator of the device. This reduces the chance that adhesive will flow or splash on the operator. In addition, in the open condition, any adhesive that collects on the blocking members tends to fall onto the substrate. This minimizes the need for cleaning the device and reduces the risk that the blocking members will provide ineffective closure of the openings.

In the preferred form of the invention, the device is used to deposit a liquid polymeric asphalt adhesive which incorporates a urethane polymer. Panels of wood fiber, perlite, fiberglass or polyisocyanurate may be bonded directly to the substrate. Applicants have found that in most cases, adhesive coverages should range from 1½ to 2 gallons of adhesive per 100 square feet of substrate. Using the device of the present invention, this coverage may be obtained by sizing openings 32 to be approximately 1 inch in diameter and by depositing 6 evenly spaced beads of adhesive per 4 foot wide section of substrate. This adhesive coverage generally may be produced by using the device of the present invention to apply a bead of adhesive to each flange on a standard fluted steel substrate panel.

In some applications, such as when polyisocyanurate or wood fiber panels are applied directly to a fluted metal deck substrate, satisfactory bonding can be obtained with lower adhesive coverage rates. In these circumstances, applicants have found that coverage in the range of 1 gallon of adhesive per 100 square feet provides a satisfactory bond. On a fluted steel deck, the coverage is obtained by applying an adhesive bead to alternative flanges.

The apparatus shown in FIGS. 1–6 may be used to provide varied adhesive coverage. This is accomplished by disengaging the middle blocking member 36 from shaft 26 by loosening locking nuts 40 on the attached collars 38. Finger 56 is rotated to engage member 36 and hold it in the first position. Nut 60 is then tightened to hold finger 56 in engagement with member 36. In this condition, middle opening 32 will remain closed while the other openings are open. Using the device in this manner enables adhesive beads to be deposited on alternative flanges of a fluted metal roof deck substrate.

In other embodiments similar locking mechanisms may be provided for the other blocking members of the device. When this is done, any two openings 32 may be held closed while one is used to deposit an adhesive bead. This may be desirable in applications in which only light adhesive coverage is desired or in cases where only a single bead is required, such as at the edges of a roof or around obstructions or penetrations.

While the embodiment of the invention shown in FIGS. 1–6 is intended to be used on standard fluted metal roof deck surfaces, it is possible to encounter fluted surfaces that have different flange spacing. On such surfaces, the fixed spacing between the wheels of the device may prevent the wheels from nesting in the flutes between the flanges. Further, the openings from the tank may not be positioned to deposit a bead of adhesive on the flanges of a non-standard substrate.

Figure 7:
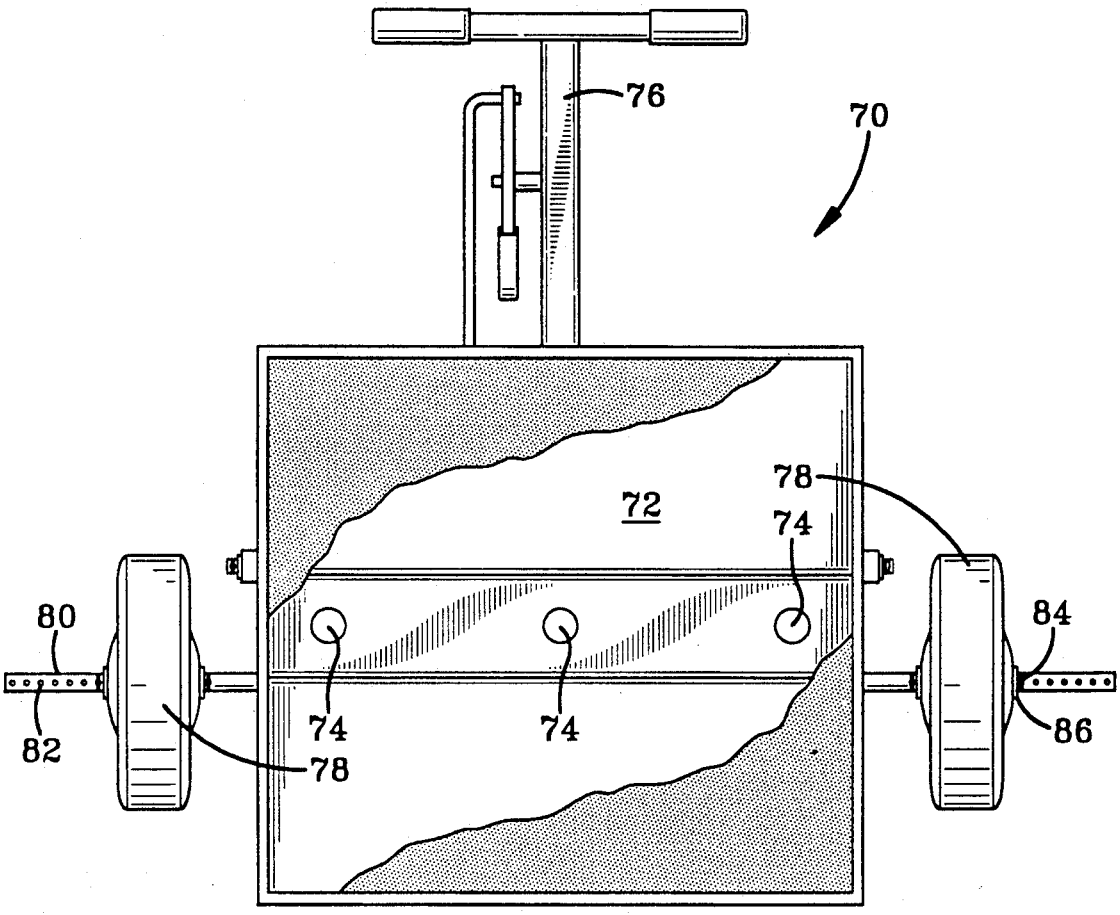
FIG. 7 is a top view of an alternative embodiment of the present invention.

In FIG. 7 an alternative embodiment of an adhesive application apparatus 70 is shown. Apparatus 70 can be used on fluted substrates with irregular flanged spacing. Device 70 has a tank 72 with a plurality of openings 74 in the bottom. Openings 74 are closed by blocking members and a valve mechanism similar to that shown in the prior embodiment. Device 70 also has a handle 76 for movement of the device across the substrate. The device also has a pair of wheels 78 mounted on a shaft 80.

Unlike the embodiment previously described, shaft 80 extends several inches beyond each side of tank 72. Shaft 80 also has a plurality of access holes 82 extending therethrough. Pins 84 extend through shaft 80 on both sides of each wheel to maintain the wheels in a fixed lateral position. Washers 86 are positioned on each side of wheel inboard of the pins, to assist the pins in holding the wheel in position.

When an irregular fluted surface is encountered, pins 84 can be removed and the wheels laterally relocated so that they fit into the flutes and one or more of the openings 74 are located over the flanges of the fluted substrate. The pins are then reinstalled in the appropriate holes 82 and the blocking members not positioned over flanges held closed by disconnecting them from the shaft and locking them using the mechanism previously described. This enables device 70 to deposit adhesive only the flanges of the fluted substrates.

Figure 8:
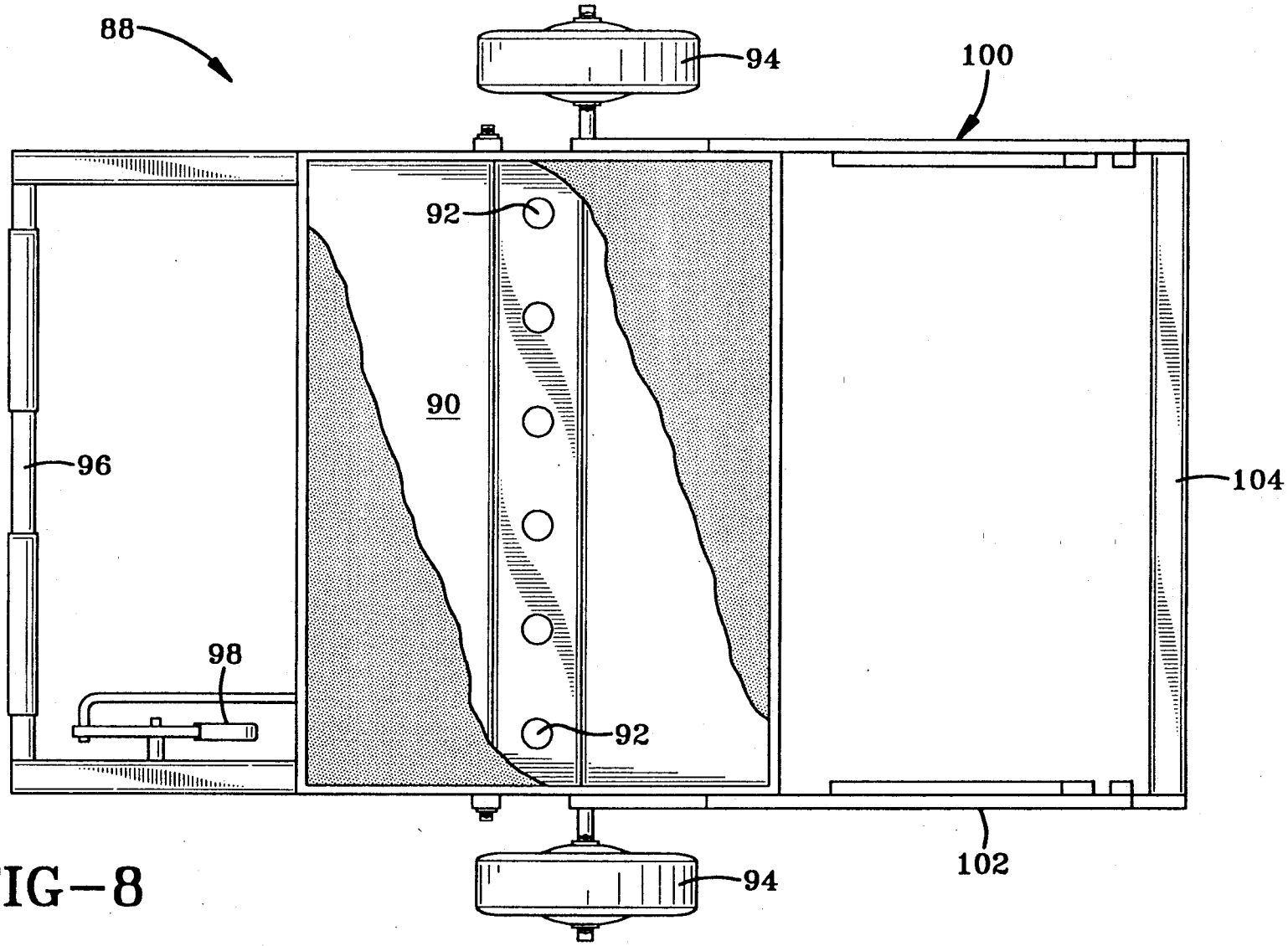
FIG. 8 is a top view of a further alternative embodiment of the adhesive application apparatus of the present invention.
Figure 9:
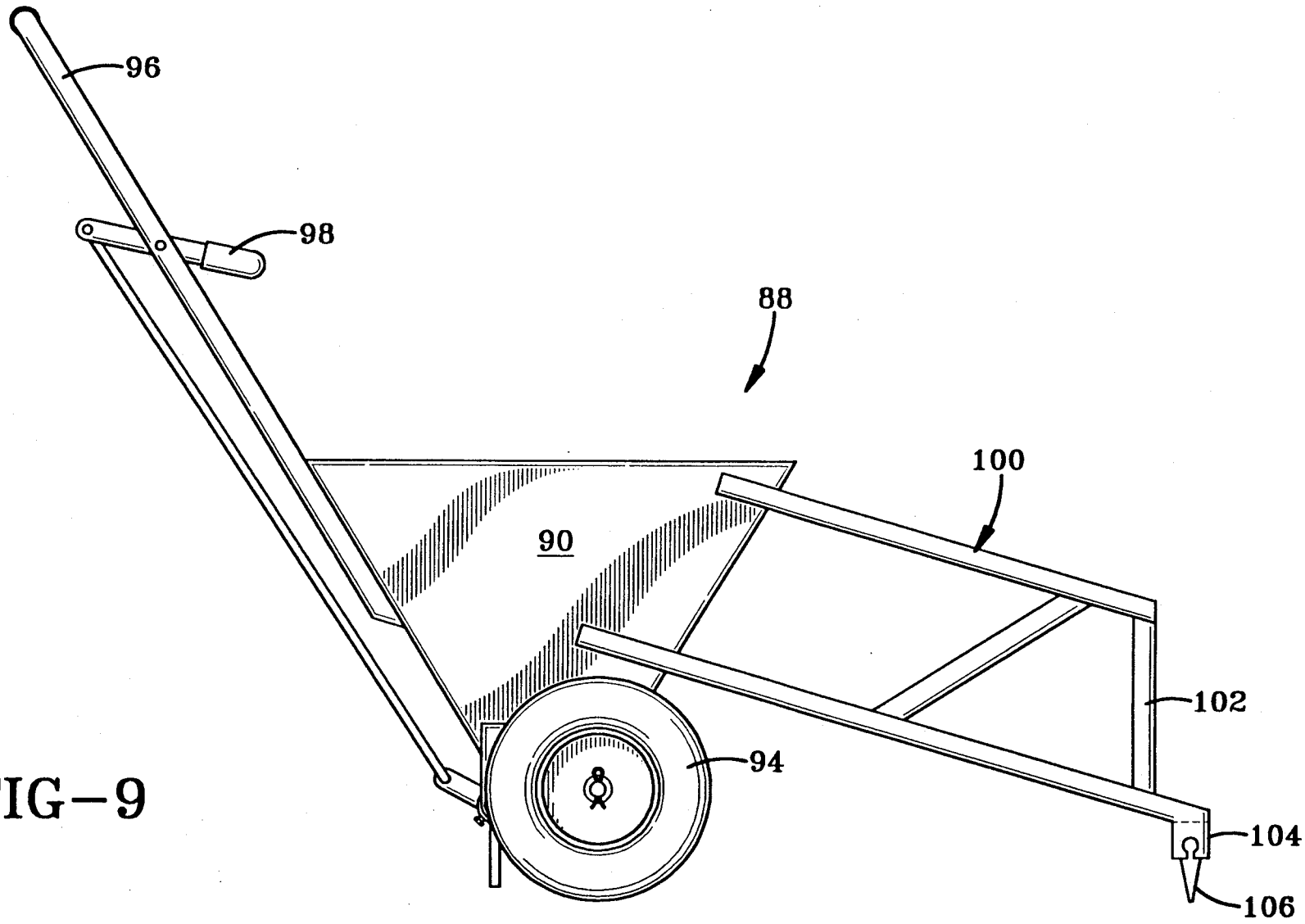
FIG. 9 is a side view of the alternative embodiment of the invention shown in FIG. 8.

A further alternative embodiment of the present invention 88 is shown in FIGS. 8 and 9. Device 88 has a tank 90 with a plurality of spaced openings 92. Six spaced openings are shown in this embodiment, all of which have associated blocking members as well as locking means of the type previously described.

Device 88 has a pair of narrow wheels 94 which are sized to fit into the flutes of many fluted surfaces, even though they may not be centered in such flutes. The device also has a handle 96 and a lever 98 for controlling opening and closing of blocking members of the type previously described.

Device 88 can achieve a range of adhesive deposition densities by varying the number of openings 92 through which adhesive is enabled to pass. Device 88 can also accommodate nonstandard fluted substrates by enabling the passage of adhesive only through openings that are positioned over flanges. The increased number of openings makes it easier to apply multiple adhesive beads in a single pass than in using the embodiment shown in FIG. 7.

Device 88 also may include a squeegee assembly 100. The squeegee assembly consists of a metal frame 102 which is preferably welded to tank 90, but in other embodiments may be held thereto by fasteners or any other suitable attaching means. Frame 102 has a wiper holder 104 which holds a rubber wiper 106.

When device 88 is used to apply adhesive to a substrate, squeegee assembly 100 operates to spread the adhesive. The beads applied through openings 92 are spread by the passage of wiper 106 shortly after the adhesive bead is deposited. The spreading of adhesive by the squeegee assembly is particularly useful on flat substrates. In addition, when it is desired to spread the adhesive more thinly, weights can be added to frame 100 to apply more pressure on wiper 106. The additional pressure forces the adhesive to flow more in the lateral direction as it passes under the wiper creating a wider, thinner adhesive bead.

Thus, the new adhesive application apparatus of the present invention achieves the above stated objectives, eliminates difficulties encountered in the use of prior systems and devices, solves problems and attains the desirable results described herein.

In the foregoing description, certain terms have been used for brevity, clarity and understanding, however, no unnecessary limitations are to be implied therefrom because such terms are used for descriptive purposes and are intended to be broadly construed. Moreover, the descriptions and illustrations given are by way of examples and the invention is not limited to the exact details shown or described.

Having described the features, discoveries and principles of the invention, the manner in which it is utilized and the advantages and useful results obtained; the new and useful structures, devices, elements, arrangements, parts, combinations, systems, equipment, operations, methods and relationships are set forth in the appended claims.

We claim:

1. An apparatus for depositing a fluid adhesive on a substrate, comprising:

holding means for holding a supply of adhesive above said substrate;

a plurality of spaced openings in a lower portion of said holding means for enabling flow of fluid adhesive therethrough onto said substrate;

a plurality of blocking members, each blocking member being associated with a corresponding one of said openings and being movable between a first position in blocking relation of said opening and a second position disposed of said opening, whereby flow is enabled through the associated openings when said blocking members are in the second position;

a rotatable shaft in operative connection with said blocking members through a plurality of lockable collars mounted on said shaft, each of said collars being operatively connected with a corresponding blocking member, said lockable collars enabling movement of at least one selected blocking member from the first position to the second position responsive to movement of said rotatable shaft;

manual actuation means in connection with said rotatable shaft; and movement means for moving said apparatus on said substrate.

2. The apparatus according to claim 1 wherein said blocking members are positioned below said openings and rotate with said shaft when an associated collar is locked thereto, whereby when said blocking are in the second position, fluid adhesive thereon falls onto said substrate.

3. The apparatus according to claim 2 wherein said apparatus further comprises locking means for locking at least one blocking member in the first position, whereby when said at least one blocking member is disengaged from said shaft said at least one blocking member is held in the first position.

4. The apparatus according to claim 3 wherein said locking means includes an engaging member means associated with at least one of said blocking members for engaging and in holding said blocking member in the first position.

5. The apparatus according to claim 4 wherein said locking means further includes fastening means for holding said engaging member means in engagement with said blocking member.

6. The apparatus according to claim 5 wherein said engaging member means is a finger, said finger being mounted for pivotal movement about said fastening means, and said fastening means being adjustable to lock said finger in engagement with said blocking member.

7. The apparatus according to claim 6 wherein said movement means comprises at least two spaced wheels.

8. The apparatus according to claim 7 wherein said wheels of said apparatus are sized for nesting between adjacent flanges of a substrate having a plurality of continuous raised flanges which extend parallel to one another, and said spaced openings in said adhesive holding means are located to enable the deposition of adhesive on at least one of said flanges.

9. The apparatus according to claim 8 wherein said openings located to enable deposition of adhesive on a plurality of flanges of said substrate.

10. The apparatus according to claim 9 wherein said apparatus further comprises adjustment means for adjusting a distance between said wheels whereby said apparatus is enabled to deposit adhesive on flanges of varied spacing.

11. The apparatus according to claim 10 and further comprising handle means for manually moving said apparatus over said substrate.

12. The apparatus according to claim 11 wherein said apparatus includes squeegee means for spreading said adhesive on said substrate as said apparatus is move thereon.

13. The apparatus according to claim 1 and further comprising squeegee means for spreading said adhesive on said substrate.

14. The apparatus according to claim 1 wherein said opening means is located to deposit adhesive on at least one flange of a substrate having a plurality of continuous raised flanges which extend parallel to one another.

15. The apparatus according to claim 14 wherein said movement means includes support means for supporting the apparatus on said substrate, and said support means comprises at least two spaced wheels each of which is sized for fitting between adjacent ones of said flanges.

16. The apparatus according to claim 14 wherein said opening means is circular and is sized to control the maximum flow rate of fluid adhesive therethrough.

17. The apparatus according to the claim 1 wherein said opening means comprise a plurality of openings and said openings are located to deposit adhesive on more than one flange of a substrate having a plurality of continuous raised flanges which extend parallel to one another.

18. The apparatus according to claim 17 wherein said movement means includes support means for supporting the apparatus on said substrate, and said support means comprises at least two spaced wheels each of which is sized for fitting between adjacent ones of said flanges.

19. The apparatus according to claim 18, wherein said support means includes a pair of spaced wheels.

20. The apparatus according to claim 19 and further comprising adjustment means for adjusting a distance between said wheels.

21. The apparatus according to claim 17 wherein said openings are circular and are sized to enable flow of fluid adhesive therethrough at a controlled rate, said apparatus further comprising selective flow means for enabling flow through selected openings while preventing flow through the remaining openings.

22. The apparatus of claim 1 wherein the movement means defines a wheel member, said wheel member being of a configuration which is capable of only partially engaging a flute of a metal deck, wherein the wheel is easily guided by the partial engagement of the wheel with the flute, but is easily pulled or pushed out of the flute so that, when a row is finished, the apparatus can be disengaged from the flute and engaged with another flute.

23. The apparatus of claim 22 wherein the wheel has a convex contacting surface.

* * * * *